United States Patent [19]

Forberg et al.

[11] 4,283,103

[45] Aug. 11, 1981

[54] ELECTRICAL CRIMP CONNECTOR

[75] Inventors: Horst Forberg; Gunter Hegner; Anneliese Stoewe, all of Berlin, Fed. Rep. of Germany

[73] Assignee: Krone GmbH, Berlin, Fed. Rep. of Germany

[21] Appl. No.: 6,032

[22] Filed: Jan. 24, 1979

[30] Foreign Application Priority Data

Jan. 31, 1978 [DE] Fed. Rep. of Germany ..... 2804478

[51] Int. Cl.[3] ..... H01R 11/00; H01R 13/58

[52] U.S. Cl. ..... 339/59 M; 339/97 P; 339/101; 339/119 R

[58] Field of Search ..... 339/97 R, 97 C, 97 P, 339/96, 98, 99, 59 M, 101, 119 R

[56] References Cited

U.S. PATENT DOCUMENTS

| | | | |
|---|---|---|---|
| 2,694,189 | 11/1954 | Wirsching | 339/97 R |
| 3,702,456 | 11/1972 | Patton | 339/98 X |
| 4,013,332 | 3/1977 | Dauser | 339/98 |
| 4,066,317 | 1/1978 | Bierenfeld | 339/98 X |
| 4,136,920 | 1/1979 | Scholtholt | 339/98 |
| 4,171,857 | 10/1979 | Forberg et al. | 339/97 P |

*Primary Examiner*—John McQuade
*Assistant Examiner*—John S. Brown
*Attorney, Agent, or Firm*—Weingarten, Maxham & Schurgin

[57] ABSTRACT

An electrical crimp connector has a plurality of two armed connecting elements made of a flat resilient contact material having a central slot. The main part of each slot extends from a widened entry aperture, is bounded by sharp edges and has a width less than the thickness of the metal core of a wire so that when the wire is pushed into the slot the insulation of wire is severed so the wire contacts the connecting element. A clamping element is associated with each connecting element and has a support surface on which the connecting element is fixed. The connecting elements are interconnected in pairs and have a number of interconnected clamping elements extending around them and are combined to form a unit having wire guides. The connecting elements are adapted to be plugged in on the support strip which is releasably connected to the insulating member on both sides of longitudinally extending lines, separate wire guides being provided on the parts which are releasable from one another.

25 Claims, 13 Drawing Figures

ELECTRICAL CRIMP CONNECTOR

DESCRIPTION

The invention relates to an electrical crimp connector between an insulated wire and a two-armed connecting element made of a flat strip-like resilient contact material and having a slot disposed centrally in the plane thereof, the main part of the slot extending from a widened entry aperture and being bounded by sharp edges and having a width less than the thickness of the metal core of the wire, so that when the same is pushed into the slot the insulation of the wire is severed and contact made between the bare wire and the connecting element. A cooperating clamping element is associated with the connecting element and serves to grip the insulated wire. In one, embodiment of the crimp connector the clamping element is formed centrally, in relation to its rectangular cross-sectional area, with a slot extending vertically downwardly and the clamping element serves as an insulating member. The connecting element is fixedly disposed on the support surface of the clamping element at an angle offset substantially by 45°, the clamping element extending around or including the connecting element in its constructional arrangement. A number of such connecting elements are interconnected in pairs having a number of interconnected clamping elements extending around them and being combined to form a unit having wire guides. This type of arrangement is described in U.S. application Ser. No. 908,937, now U.S. Pat. No. 4,171,857.

The invention relates to an improvement and an advantageous development of this device.

It is an object of the invention to improve the device as regards manufacture, assembly and handling.

This problem is solved mainly according to the invention in that the connecting elements are adapted to be plugged in on the support strip and the same is releasably connected to the insulating member which forms an independent unit and comprises a number of interconnected clamp elements on both sides of longitudinally extending lines, separate wire guides being provided on the parts which are releasable from one another.

Other advantageous constructions of the various features of the invention are characterised in the subclaims.

An embodiment of this invention will be described now by way of example only with reference to the drawings wherein.

Figure 1:
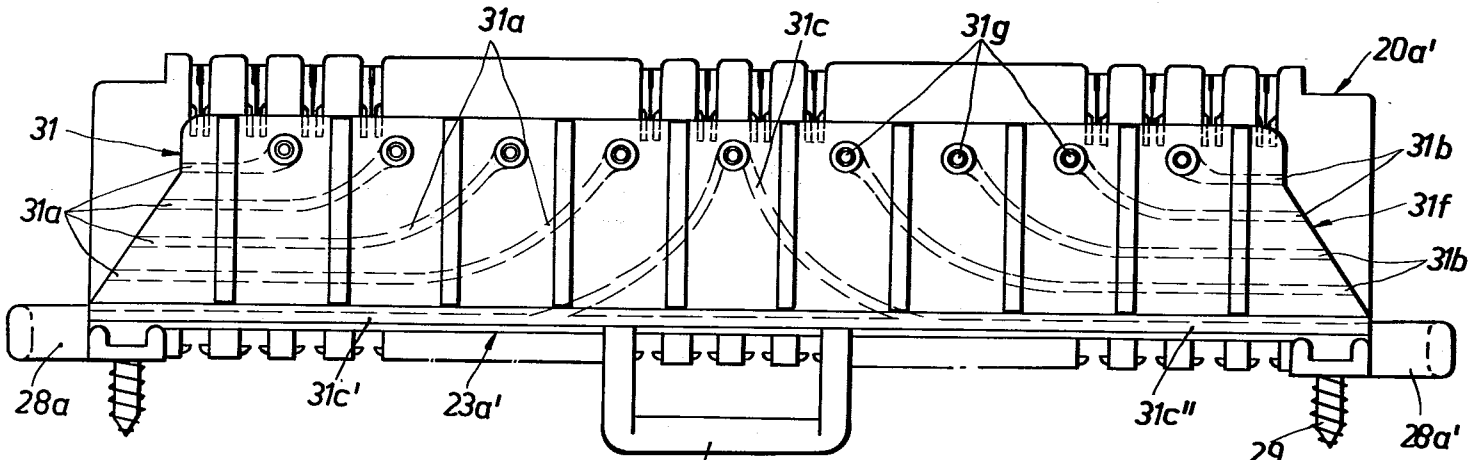
FIG. 1 is a view in side elevation of a construction of a common link comprising a number of improved crimp connectors.
Figure 2:
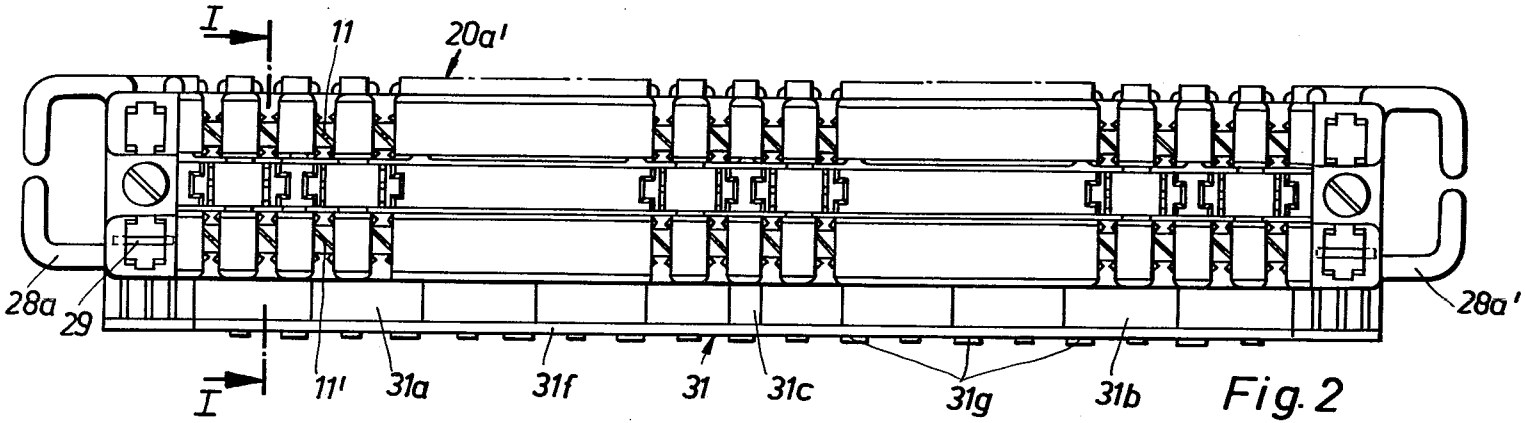
FIG. 2 is a plan view of the link of FIG. 1.
Figure 3:
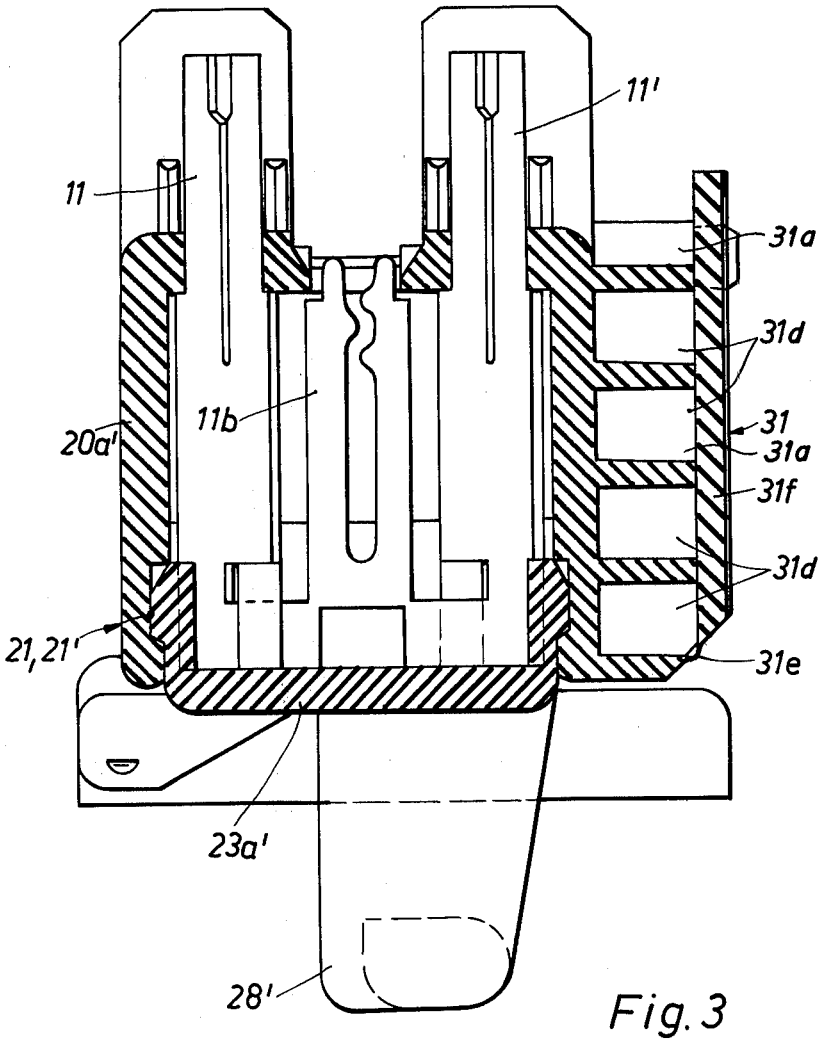
FIG. 3 is a view in cross-section through the improved crimp connector on the line I—I of FIG. 2.
Figure 4:
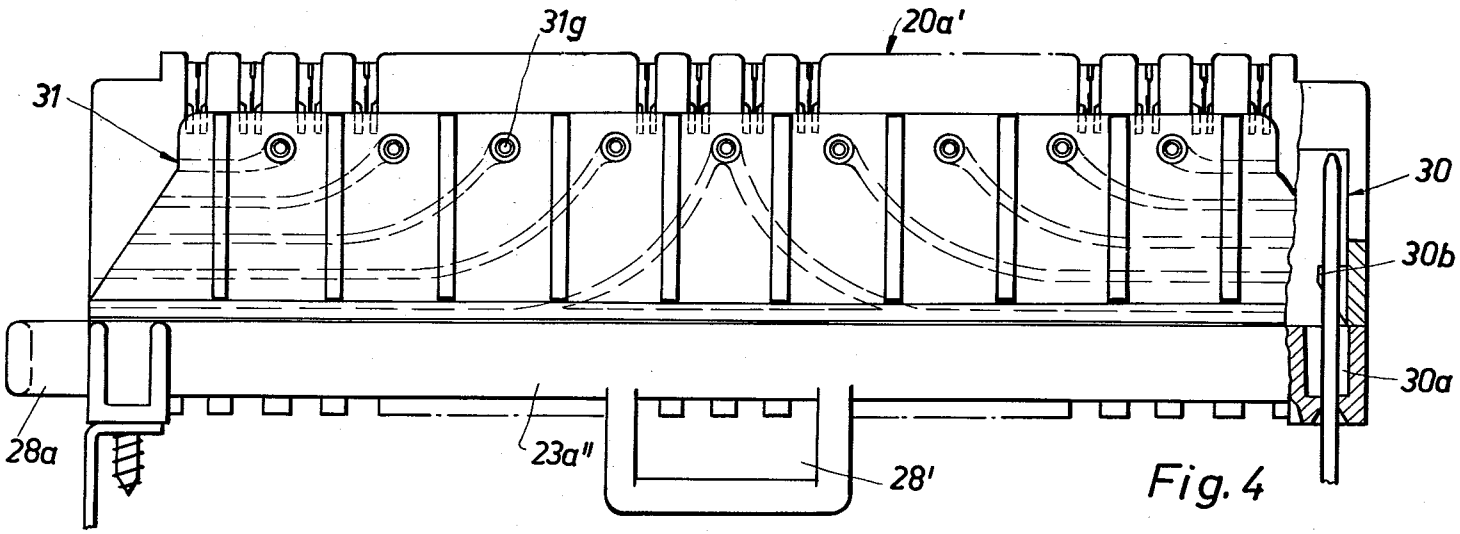
FIG. 4 is a view in side elevation similar to FIG. 1 of another form of a strip for isolated connectors, the strip being embodied by a number of improved crimp connectors.
Figure 5:
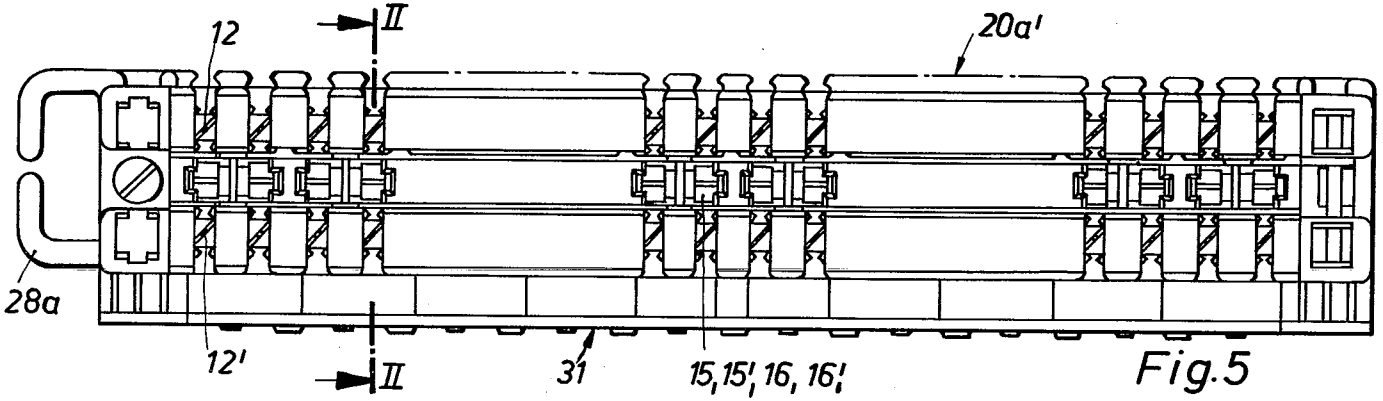
FIG. 5 is a plan view of the strip of FIG. 4.
Figure 6:
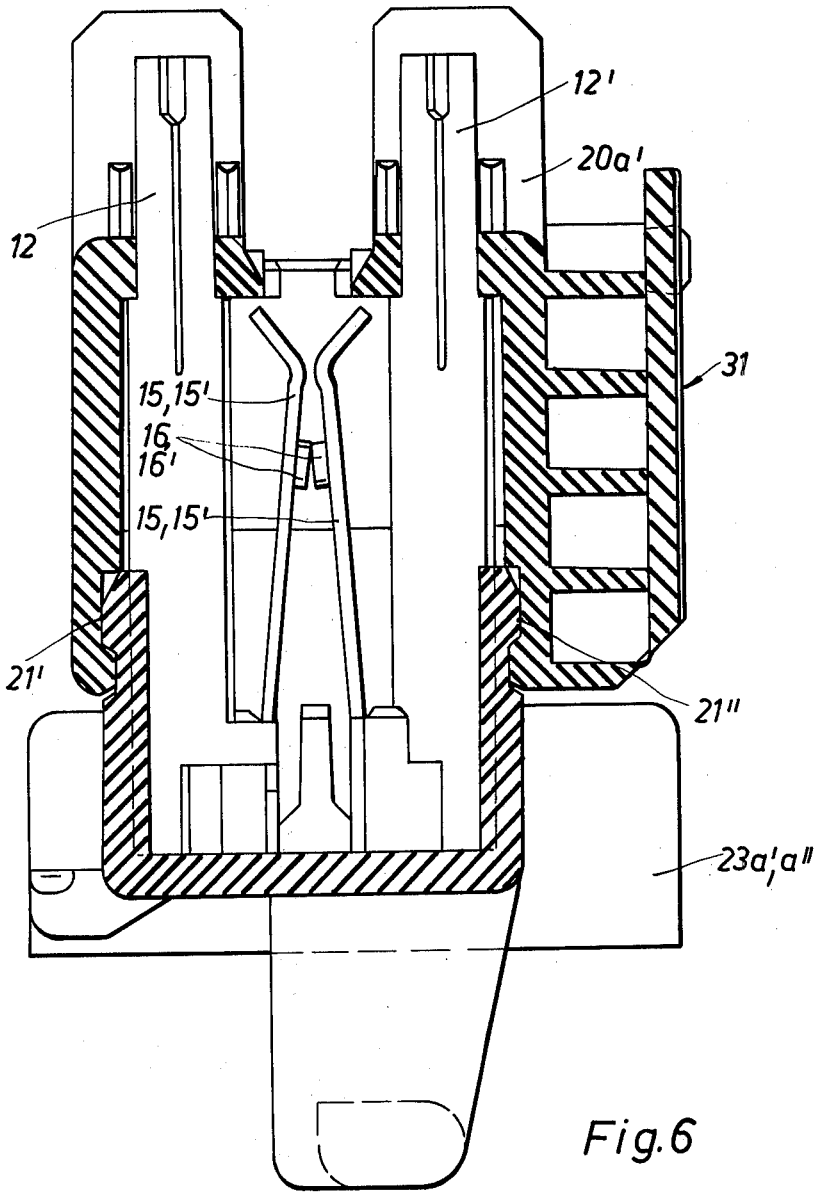
FIG. 6 is a view in cross-section through the connector of FIG. 5 on the line II—II thereof.
Figure 7F:
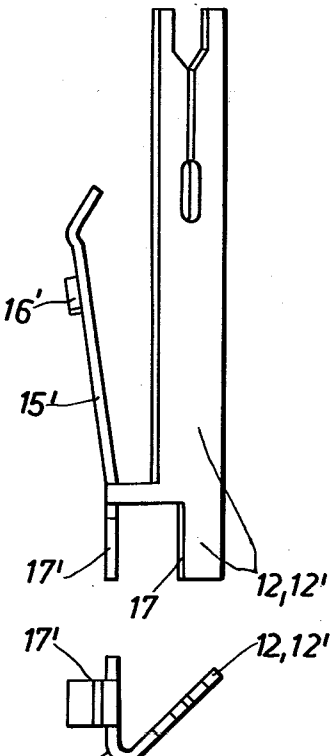
Figure 7C:
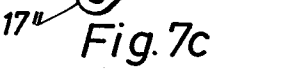
Figure 7E:
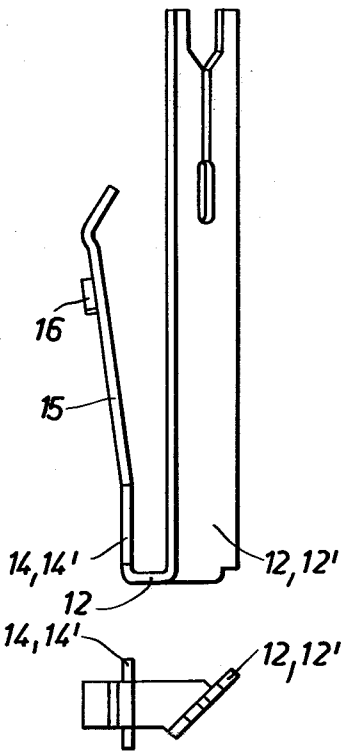
Figure 7B:
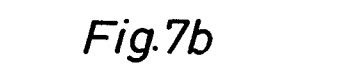
Figure 7D:
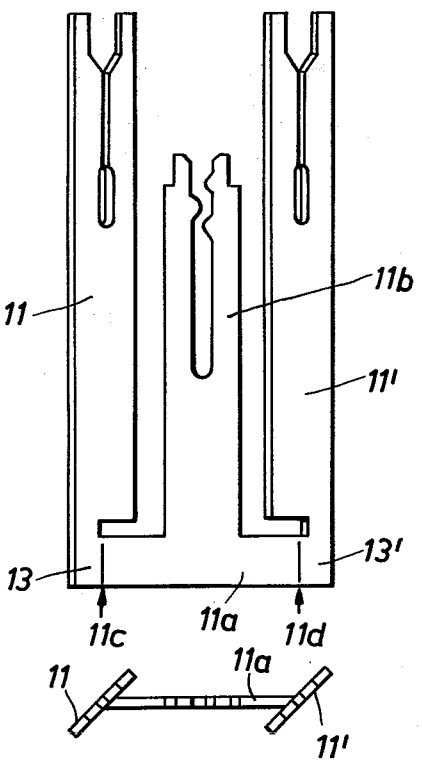
Figure 7A:
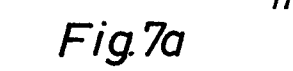
Figure 8:
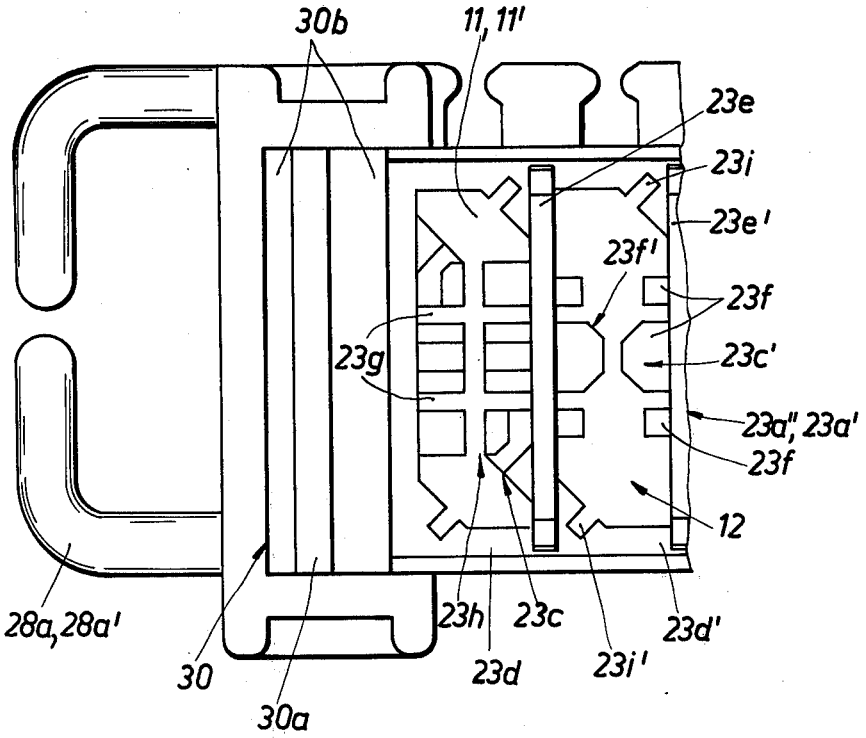

FIG. *7a* is a bottom view of the connecting element for the common link shown in FIGS. 1 to 3;

FIG. *7b* is a separate bottom view of the connecting element of the openable crimp connector of FIGS. 4 and 5;

FIG. *7c* shows a bottom view of another form of the connecting element of the openable crimp connector of FIG. 6;

FIG. 7(*d*) is a side view of the connecting element of FIG. 7(*a*);

FIG. 7(*e*) is a side view of the connecting element of FIG. 7(*b*);

FIG. 7(*f*) is a side view of the connecting element of FIG. 7(*c*) and;

FIG. 8 is a plan view of the support plate of FIGS. 1 to 6 to show the plug-in connection for the crimp connectors of FIGS. 3 and 6 in two of the chambers of the two strips shown in FIGS. 1 to 5 and 4 to 6 respectively.

As can be seen from FIG. 1 to 5, particularly in FIG. 3, connecting element 11, 11' and 12, 12' (FIG. 5) (the latter for making up the strip for isolated connectors) can be plugged in at choice on a support strip 23*a'*. To ensure rapid and ready fitting, the strip 23*a'* is releasably connected to an insulating member 20*a'* on both sides of longitudinally extending lines, 21, 21', separate wire guides 31 and 28*a*, 28*a'* being provided on the parts 20*a'*, 23*a'* which are releasable from one another.

This association between the novel wire guide 31 (see FIG. 1) and the known wire guides 28*a*, 28*a'* for the outgoing wires and wire guide 28' of the incoming wires makes it possible to have a good view of the work when fitting up the present crimp connector.

The overall advantage provided by these features is that to produce a common link or a strip for isolated connectors, the same plastic items 20*a'* and 23*a'*, and support strip 23*a''* (as shown in FIG. 4) are used and only the connecting elements 11, 11' and 12, 12' have to be prepared and they are readily interchangeable.

In this case, and as shown in FIGS. 2, 3, 5 and 6, the associated connecting elements 11, 11' and 12, 12' are offset at 45° to an insulated wire passing therethrough (not shown) but in the same direction—so that the surfaces of element 11 are parallel to the surfaces of element 11'. The connecting elements 11, 11', 12, 12' have at their bottom end extensions e.g. 13, 14 as shown in FIGS. *7d* and *7e* engageable in a multipin connector 23*c*, 23*c'* of the support plate 23*a'*, as is most clearly apparent from FIG. 8, which shows two embodiments in the chamber 23*d* and 23*d'*, the multipin connector 23*c'* being even simpler than the multipin connector 23*c*.

According to a suggestion for the improved common link, the connecting elements 11, 11' interconnected by a cross-web 11*a* have on the underside an extension 13 of S-shaped cross-section. As FIG. *7a* shows, the extension 13 is devised by bending the metal piece 11*a* through 45° and in opposite directions at the bending edges 11*c* and 11*d*. Also, as shown in FIG. *7a*, an additional connecting element 11*b* may be provided between connecting elements 11 and 11' and extending upwardly from extension 13.

In the novel strip for isolated connectors, the various connecting elements 12 and 12' each have a formed-on spring 15, 15' which has a contact 16, 16', the springs being at an angle to the connecting elements and also having an extension 14, 14' and 17, 17', 17'' respectively for engagement in the same multipin connector 23*c*, 23*c'* *of the support strip 23a'* (FIG. *7b* or *7c*). Contacts 16, 16' of the two confronting springs 15, 15' are normally biased into electrical connection by springs 15, 15' to form a normally closed contact. This construction has the advantage that the connecting elements 12 and 12' coincide geometrically, thus simplifying production.

In this event, the normally closed contacts 16, 16' and their associated springs 15, 15' are so devised as to be openable by means of a known separating plug which may comprise an appropriately shaped piece of insulating material which can be inserted between the contacts 15, 15' or 16, 16' shown in FIG. 6.

Since the two springs 15, 15' each have an identically constructed contact in the form of a contact strip 16, 16' extending at an angle to the length of such springs (FIGS. 6 and 7*b* or 7*c*), a reliable electrical contact is provided.

With regard to the use of LSA contacts, for each pair of connecting elements 11, 11'; 12, 12' there is provided a multipin connector 23*c*, 23*c'* one each in a chamber 23*d*, 23*d'* bounded by the side walls and the cross-walls 23*e*, 23*e'* in the support strip 23*a'* (FIG. 8). As can be gathered in detail from FIG. 8, the multipin connector 23*c* is in the form of spaced-apart longitudinal members 23*f*, 23*f'* formed with longitudinal slots 23*g* and with a transverse slot 23*h* and of inclined slots 23*i*, 23*i'*.

According to a feature of the invention in connection with the wire guides previously referred to, one centrally open guide collar 28*a*, 28*a'* is formed on each end face of the support strip 23*a'* for the bunch of outgoing wires (not shown).

A very important feature of this invention is that a wire guide 31 adapted to be covered by a hinged cover 31*f* and serving for further guiding of the outgoing wires is disposed on one side wall of the insulating member 20*a'* (FIGS. 1, 3, 4 and 6).

In this event, the cover 31*f* is articulated to the underside of the insulating member 20*a'* by means of a film hinge 31*e*.

The wire guide 31 has ribs 31*a*, 31*b*, 31*c* which bound channels 31*d* for receiving the outgoing wires.

According to a feature of the invention, the wire guide 31 has two coplanar and laterally adjacent groups of ribs 31*a*, 31*b* and between them a continuous rib 31*c* is disposed on the underside of the wire guide 31 and the cover 31*f* is articulated via the film hinge 31*e* to the straight parts 31*c'* and 31*c''* of the latter rib 31*c*.

It is of course possible within the scope of the invention for the ribs 31*a*, 31*b*, 31*c* to be formed wholly or to some extent on the cover 31*f* and/or on the side wall of the insulating member 20*a'*.

To close the wire guide cover 31*f*, the side wall of the insulating member 20*a* has at the top end of the ribs 31*a*, 31*b*, 31*c* a press button 31*g* projecting through a hole formed in cover 31*f* and engaging the side wall of the insulating member 20*a'*.

Consequently, the cover 31*f* including the press button 31*g*, ribs 31*a*, 31*b*, 31*c*, the film hinge 31*e* and the insulating member 20*a'* form a constructional unit which can be produced in a single working step.

According to another feature of the invention, and as shown on the left-hand side of FIG. 8, the support strip 23*a'* has securing means 30 on each end face for assembly by means of screws 29 on a unit (not shown) for receiving an array of the connectors shown in FIGS. 1 and 2.

In detail, the securing means 30 are in the form of a slot 30*a* and a snap connection 30*b* (FIG. 8).

Preferably, a tongue-and-groove snap connection (FIG. 6) is provided for securing the insulating member 20*a'* releasably to the support plate 23*a'* (FIGS. 3 and 6).

Finally, the multipin connector 23*c*, 23*c'* is formed preferably on the inside of the support strip 23*a'*, 23*a''*, with the advantage that a unitary support strip like the unitary insulating member 20*a'* is provided.

We claim:

1. An electrical crimp connector for forming a connection with an insulated wire, comprising:

an insulating member formed of a plurality of interconnected clamping elements, each of said clamping elements having a slot extending downwardly from a top surface thereof to a bottom surface thereof;

a support strip releasably secured to said bottom surface of said insulating member;

a pair of connecting elements associated with each clamping element and being joined by a transverse web, each of said containing elements being flat, strip-like and resilient and being formed of an electrically conductive material, each of said connecting elements having a slot centrally disposed thereof, each of said slots having a lower portion with a width less than the diameter of an insulated wire and an entry portion having a width greater than the width of the lower portion, said lower portion of said slot having sharp edges along the sides thereof for severing insulation on said insulated wire and contacting the core of said insulated wire for gripping thereof as said insulated wire is inserted into said lower portion of said slot, each of said pairs of connecting elements being insertable into an enclosure formed in an associated clamping element;

a multipin connector disposed on said support strip and adapted to receive connecting elements of different configurations, each of said pairs of connecting elements being pluggable into said multipin connector;

a wire guide disposed on said insulating member; and a wire guide disposed on said support strip independently of said insulating member wire guide.

2. A device according to claim 1, wherein said connecting element of each pair of connecting elements is parallel to the other one of its pair of connecting elements and forms an angle of generally 45° with respect to an insulated wire inserted therein, and wherein each pair of connecting elements further comprises an extension projecting from its transverse web which is engageable by said multipin connector.

3. A device according to claim 1 or 2 wherein each of said pairs of connecting elements interconnected by a transverse web have on the underside thereof formed as an extension thereof a common projection having an S-shaped cross section.

4. An electrical crimp connector for forming a connection with an insulated wire, comprising:

an insulating member formed of a plurality of interconnected clamping elements, each of said clamping elements having a slot extending downwardly from a top surface thereof to a bottom surface thereof;

a support strip releasably secured to said bottom surface of said insulating member;

a pair of connecting elements associated with each clamping element, each of said connecting elements being flat, strip-like resilient and being formed of an electrically conductive material, each of said connecting elements having a slot centrally disposed thereof, each of said slots having a lower portion with a width less than the diameter of an insulated wire and an entry portion having a width greater than the width of said lower portion, said lower portion of said slot having sharp edges along the sides thereof for severing insulation on said insulated wire and contacting the core of said insulated wire for gripping thereof as said insulated wire is inserted into said lower portion of said slot, each of said connecting elements being insertable into an enclosure formed in an associated clamping element;

a multipin connector disposed on said support strip and adapted to receive connecting elements of different configurations, each of said connecting elements being pluggable into said multipin connector;

a wire guide disposed on said insulating member;

a wire guide disposed on said support strip independently of said insulating member wire guide; and a spring formed on each of said connecting elements and being disposed at an angle with respect to its associated connecting element, each of said springs having a contact, said contact of said spring of one connecting element of each pair of connecting elements being normally in electrical connection with said contact of said spring of the other connecting element of each pair of connecting elements to form an openable, normally closed contact, each of said springs having an extension for engagement in said multipin connector.

5. A device according to claim 4 wherein said normally closed contacts and their springs are openable by means of a separating plug.

6. A device according to claim 5 wherein said connecting element springs each have an identically constructed normally closed contact in the form of a contact strip extending at an angle to the length of its spring.

7. A device according to claim 1 or 2 wherein for each pair of connecting elements there is provided one multipin connector in a chamber bounded by side walls and cross-walls of the support strip.

8. A device according to claim 1 or 2 wherein said multipin connector is formed of spaced apart longitudinal members having longitudinal slots, a transverse slot and inclined slots.

9. A device according to claim 1 wherein said support strip wire guide comprises one centrally open guide collar formed on each end face of the support strip for a bunch of outgoing wires.

10. A device according to claim 1 wherein said insulating member wire guide comprises a wire guide adapted to be covered by a cover and serving for guiding of outgoing wires, said insulating member wire guide being disposed on one side wall of the insulating member.

11. A device according to claim 10 wherein the cover is articulated to the underside of the insulating member by means of a film hinge.

12. A device according to claim 10 or 11 wherein the insulating member wire guide has ribs which bound channels for receiving outgoing wires.

13. A device according to claim 12 wherein the insulating member wire guide has two coplanar and laterally adjacent groups of ribs.

14. A device according to claim 13 wherein a continuous rib is disposed on the underside of the insulating member wire guide and the cover is articulated via the film hinge to straight parts of said continuous rib.

15. A device according to claim 14 wherein the ribs are formed at least to some extent on the cover and on the side wall of the insulating member.

16. A device according to claim 15 wherein the cover has at the top end of the ribs a press button engaging the side wall of the insulating member.

17. A device according to claim 16 wherein the cover, ribs, film hinge and insulating member form a constructional unit.

18. A device according to claim 1 wherein the support strip has securing means on each end face for assembly on a unit for receiving an array of electrical crimp connectors.

19. A device according to claim 18 wherein the securing means are in the form of a slot and a snap connection.

20. A device according to claim 1 wherein a tongue-and-groove snap connection is provided for securing the insulating member releasably to the support strip.

21. A device according to claim 1 and 2 wherein the multipin connector is formed on an inside of the support strip facing said insulating member.

22. A device according to claim 2 or 4 wherein said multipin connector is formed on an inside surface of said support strip facing said insulating memeber.

23. A device according to claim 8 wherein said multipin connector is formed on an inside surface of said support strip facing said insulating member.

24. A device according to claim 12 wherein said ribs are formed on said cover.

25. A device according to claim 12 wherein said ribs are formed on said side wall of said insulating member.

* * * * *